US005898351A

United States Patent [19]

Kurono et al.

[11] Patent Number: 5,898,351

[45] Date of Patent: Apr. 27, 1999

[54] MULTIPOLAR CIRCUIT BREAKER

[75] Inventors: Toru Kurono, Seto; Masakazu Saida, Nagoya; Tatsuya Nagashima, Owariasahi, all of Japan

[73] Assignee: Nitto Electric Works, Ltd., Aichi-ken, Japan

[21] Appl. No.: 08/764,140

[22] Filed: Dec. 12, 1996

[30] Foreign Application Priority Data

Jan. 22, 1996 [JP] Japan ..... 8-008429

[51] Int. Cl.[6] ..... H01H 9/00

[52] U.S. Cl. ..... 335/172; 335/8; 335/9

[58] Field of Search ..... 335/8–10, 23–25, 335/35, 167–176

[56] References Cited

U.S. PATENT DOCUMENTS

| | | | |
|---|---|---|---|
| 3,069,517 | 12/1962 | Cole | 335/8 |
| 3,278,708 | 10/1966 | Casey et al. | 335/25 |
| 3,760,308 | 9/1973 | Misencik et al. | 337/43 |
| 3,774,126 | 11/1973 | Araki | 335/9 |
| 3,959,752 | 5/1976 | Strobel et al. | 335/8 |
| 5,294,901 | 3/1994 | Tacinelli et al. | 335/35 |

*Primary Examiner*—Lincoln Donovan

*Attorney, Agent, or Firm*—Frishauf, Holtz, Goodman, Langer & Chick

[57] ABSTRACT

A multipolar circuit breaker is provided for securely operating tripping sections of other poles when the tripping section of any pole operates. In the case of a first embodiment, a protrusion 5 for further moving a trigger plate in the tripping direction when a cradle 3 is tripped is provided for the cradle 3 of each pole so that the movement of the trigger plate 1 is securely transmitted to other poles connected by a trigger joint 2. Moreover, in the case of a second embodiment, a protrusion for further moving the trigger plate 1 in the tripping direction by pushing the cradle 3 when the cradle 3 is tripped is provided for the trigger plate of each pole to obtain the same above mentioned advantage.

2 Claims, 6 Drawing Sheets

MULTIPOLAR CIRCUIT BREAKER

BACKGROUND OF THE INVENTION

1. Field of the Invention

The present invention relates to an improved multipolar circuit breaker used for a molded-case circuit breaker or an earth-leakage circuit breaker.

2. Description of Prior Art

In the case of a multipolar circuit breaker having a plurality of poles to be used to break a plurality of circuits, the pole of each circuit is independently provided with a mechanical section such as a cradle or a tripping section and thus, a structure must be used in which, when the tripping section of the pole of any circuit operates, tripping sections of poles of other circuits operate so that the circuits can be broken.

Therefore, conventionally, as shown in FIGS. 8 and 9, bottoms of trigger plates 1 of tripping sections of poles are connected to each other by a trigger joint 2 so that, when the trigger plate 1 of any pole is moved and a cradle 3 is tripped due to an overcurrent or the like, tripping is performed also in other poles.

However, the engagement amount between the trigger plate 1 and the cradle 3 slightly fluctuates every pole, or even if tripping is performed in one pole, it may not be performed in other poles due to a slight backlash between the trigger plate 1 and the trigger joint 2. Therefore, a severe factory-adjustment must be performed to prevent the above problem.

Problems to be Solved by the Invention

The present invention is made to solve the above conventional problem and its object is to provide a multipolar circuit breaker which makes it possible to securely operate tripping sections of poles of other circuits when the tripping section of the pole of any circuit operates.

SUMMARY OF THE INVENTION

Means for Solving the Problem

The present invention made to solve the above problem uses a multipolar circuit breaker comprising trigger plates of tripping sections of a plurality of poles connected to each other by a trigger joint, and includes a mechanism for further moving a trigger plate in the tripping direction when the cradle of any pole is tripped from the trigger plate.

According to a first embodiment of the invention a protrusion is formed on a cradle and according to a second embodiment of the invention, a protrusion is formed at the trigger plate.

These protrusions are provided so as to further move a trigger plate in the tripping direction when it is tripped from a cradle.

DETAILED DESCRIPTION OF THE PREFERRED EMBODIMENTS

The preferred embodiments of the present invention are described below in detail by referring to the accompanying drawings.

Figure 1:
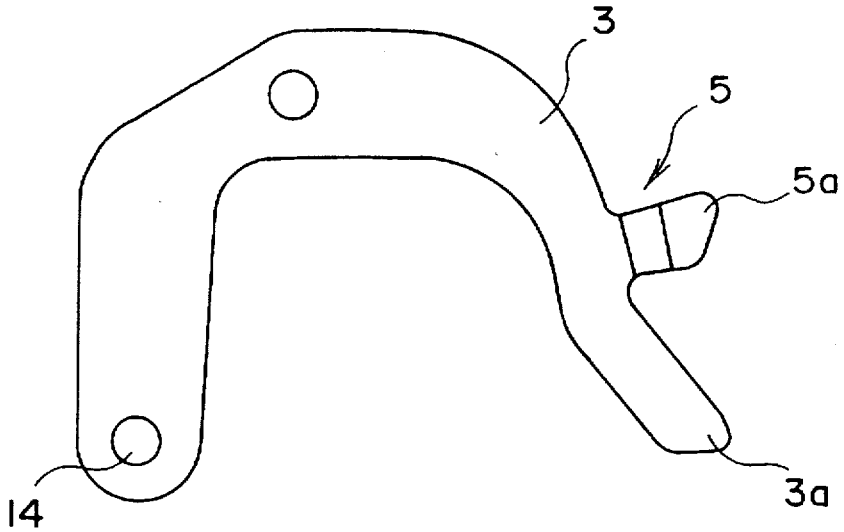
FIG. 1 is a front view of the first embodiment of a cradle of the present invention.
Figure 2:
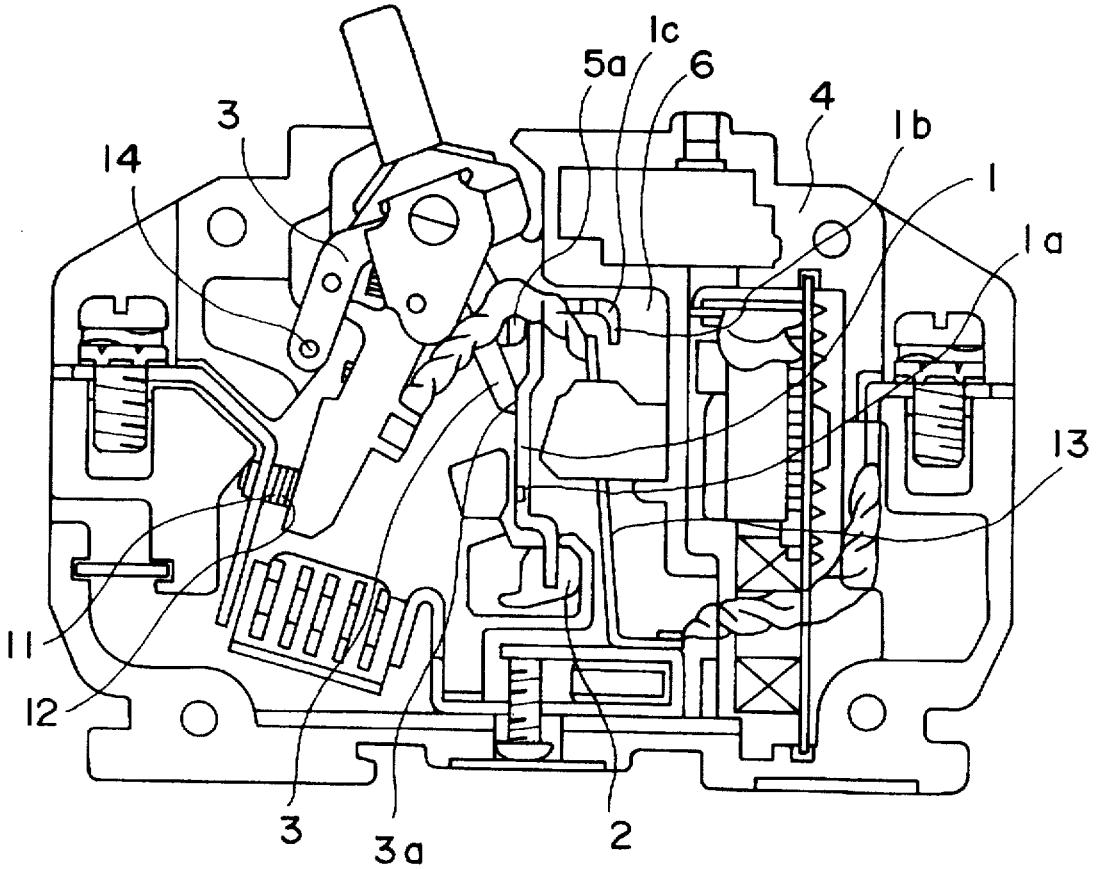
FIG. 2 is an illustration of a multipolar circuit breaker using the cradle of the first embodiment after removing its front cover in order to show the ON state of the breaker.
Figure 3:
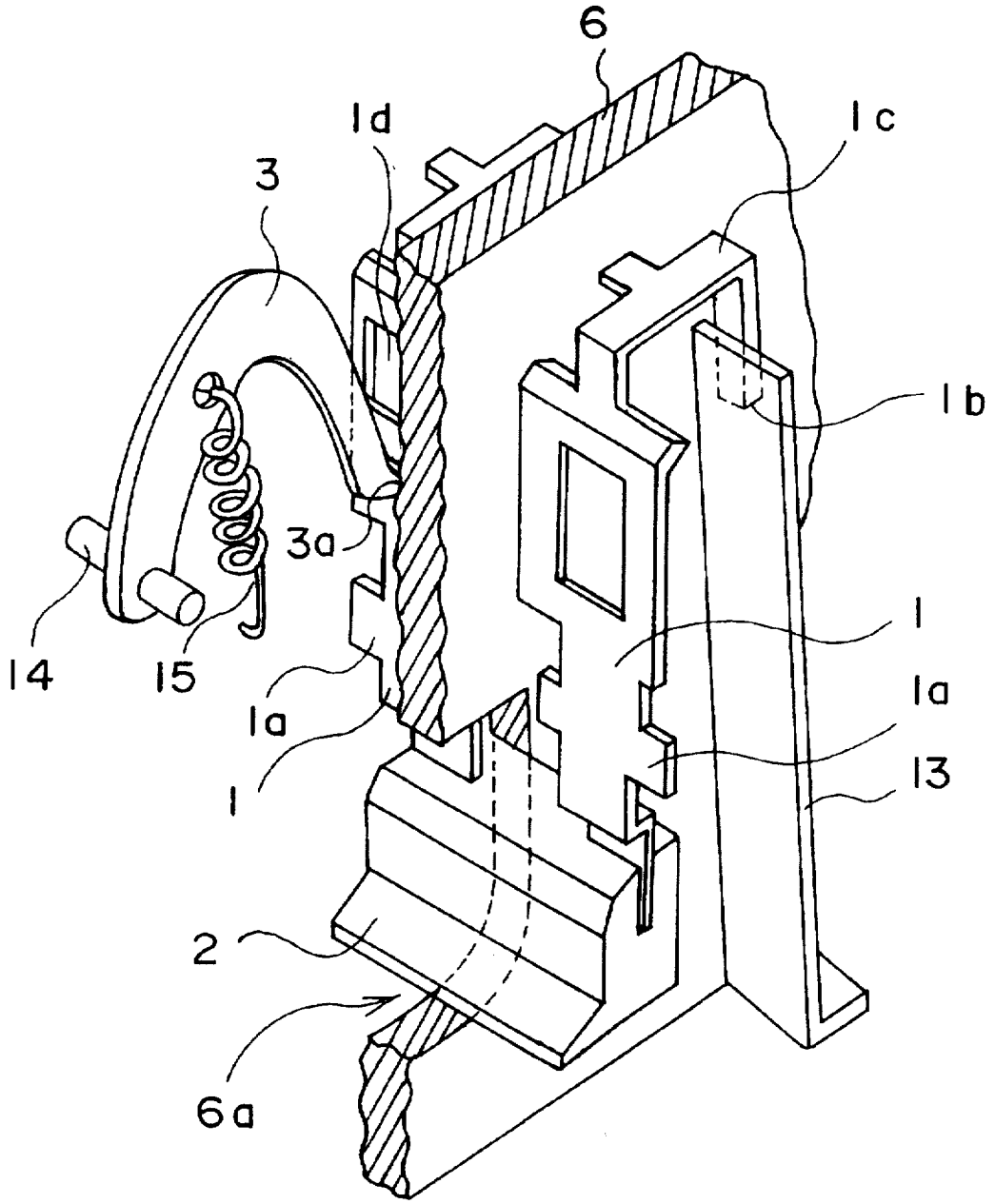
FIG. 3 is a partial perspective view of FIG. 2.

FIGS. 1 to 7 show an embodiment of the present invention wherein a multipolar circuit breaker provided within a case 4 includes housing tripping sections of two poles of two circuits at the both sides of a partition 6 (see FIG. 3). Also in this case, the trigger plates 1 of the poles are connected to each other by the trigger joint 2, and the partition 6 is provided with an opening 6*a* so that the trigger joint 2 can be rotated.

The multipolar circuit breaker of the present invention, whose internal structure behind by removing a front cover is shown in FIG. 2, is used for the two-circuit two-pole type, in which first and second circuits are constituted in first and second spaces separated by the partition 6 in the case 4.

In FIG. 2, only the front first circuit can be seen and the second circuit is present behind the first circuit. Both circuits are respectively provided with a trigger plate 1, cradle 3, fixed contact 11, movable contact 12, and bimetal 13 which bends itself due to overcurrent.

The trigger joint 2 is fitted to the bottom of the adjacent two trigger plates 1. A pair of fulcrums 1*a* for rotatably supporting the trigger plate 1 are set slightly above the trigger joint 2.

A reverse-U-type bent portion whose front end 1*b* engages with the top end of the bimetal 13 in the ON-state (normal state) is formed at the top end of the trigger plate 1.

The cradle 3 is supported by a pivot 14 and pulled downward by a spring 15. In the ON-state, however, the front end 3*a* of the cradle 3 engages with the bottom margin 1*e* of a hole 1*d* formed on the trigger plate 1 and stops.

Figure 5:
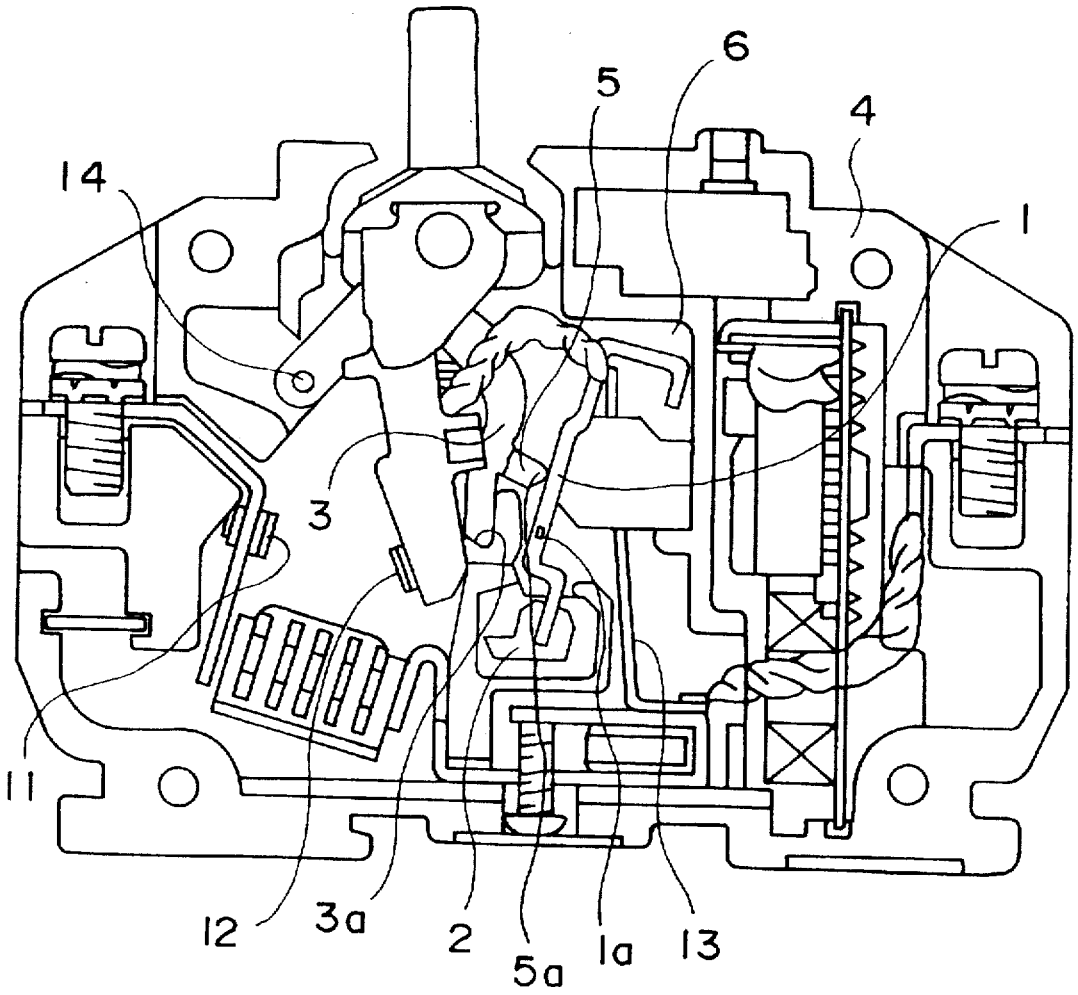
FIG. 5 is an illustration of a multipolar circuit breaker of the present invention after removing its front cover in order to show the TRIP-state of the breaker.

In the case of the trigger plate 1, the reverse-U-type bent portion 1*c* is pulled rightward and rotates clockwise about the fulcrum 1*a* when the top end of the bimetal 13 is bent rightward due to overcurrent. In this case, the front end 3*a* of the cradle 3 engaging with the bottom margin 1*e* of the hole 1*d* of the trigger plate 1 is tripped from the above engaging state. As a result, the cradle 3 is rotated downward (clockwise) by the action of the spring 15 to separate the moving contact 12 shown in FIG. 2 from the fixed contact 11 by a known toggle mechanism (not illustrated). Thereby, as shown in FIG. 5, breaking of the first circuit, that is, switching of the first circuit to the OFF-state is completed (see FIG. 5).

Though not shown in the front view of FIG. 2, a second circuit having the same structure as the illustrated first circuit is provided at the other side of the partition 6 in the case 4. This state is shown by partial perspective views of FIGS. 3 and 4. The bottoms of the trigger plates 1 of the first and second circuits are connected to each other by the trigger joint 2. Therefore, when the trigger plate 1 of the pole of either circuit rotates in the tripping direction, the trigger plate 1 of the other circuit is forcibly rotated. However, because the operation maybe uncertainly performed, conventionally a triggering problem may occur as described hereinabove under the heading "Background of the Invention".

Figure 4:
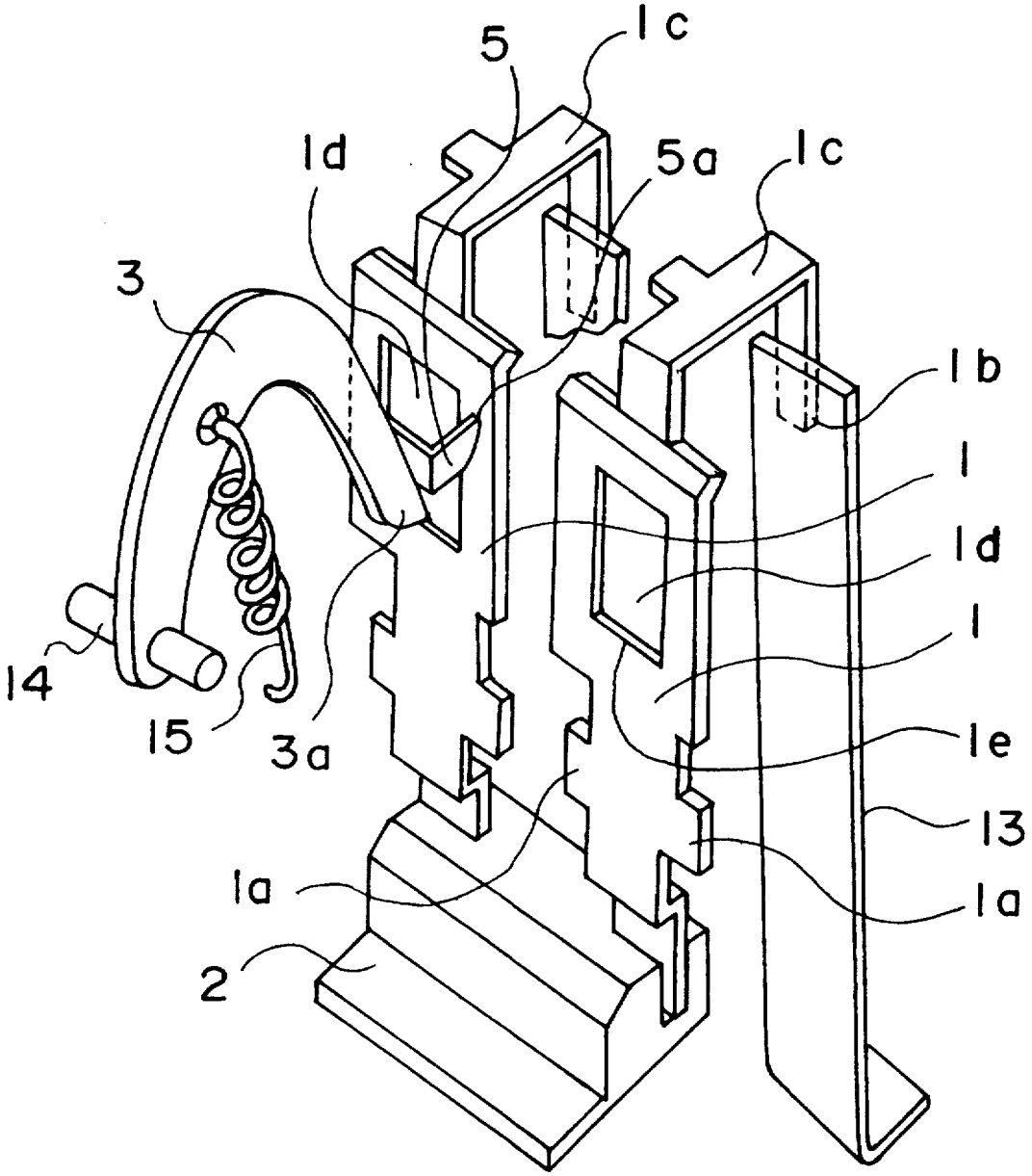
FIG. 4 is a perspective view of FIG. 3 when removing a partition between first and second circuits.

The first embodiment of the present invention is provided with a protrusion 5 at a position slightly above the front end 3*a* of the cradle 3 of each pole toward the trigger plate 1 as shown in FIG. 1. The protrusion 5, as clearly shown by the perspective view in FIG. 4, is once folded toward the one side and then bounded toward the trigger plate 1 again, and its front end 5*a* is formed so as to face the side frame portion of the hole 1*d* of the trigger plate 1 by avoiding the hole 1*d*.

The front end 5*a* of the protrusion 5, in the ON-state shown in FIG. 2, is kept so as not to contact or press the trigger plate 1 in the ON-state shown in FIG. 2 even when the front end 3*a* of the cradle 3 contacts the trigger plate 1. However, when the trigger plate 1 of any pole operates and the front end 3*a* of the cradle 3 disengages and comes to the TRIP-state shown in FIG. 5, the front end 5*a* of the protrusion 5 provided for the cradle 3 pushes (or strikes) the trigger plate 1 of its own and further deeply moves the trigger plate 1 in the tripping direction.

Therefore, the trigger plate 1 of the pole now tripped is greatly moved from the position where the front end 3*a* of the cradle 3 disengages to thereby also move the trigger plates 1 of the poles of other circuits connected by the trigger joint 2 simultaneously. As a result, even though the engagement amount between the trigger plate 1 and the cradle 3 slightly fluctuates for each pole or there is a slight backlash between the trigger plate 1 and the trigger joint 2, tripping is securely performed in other poles.

Figure 6:
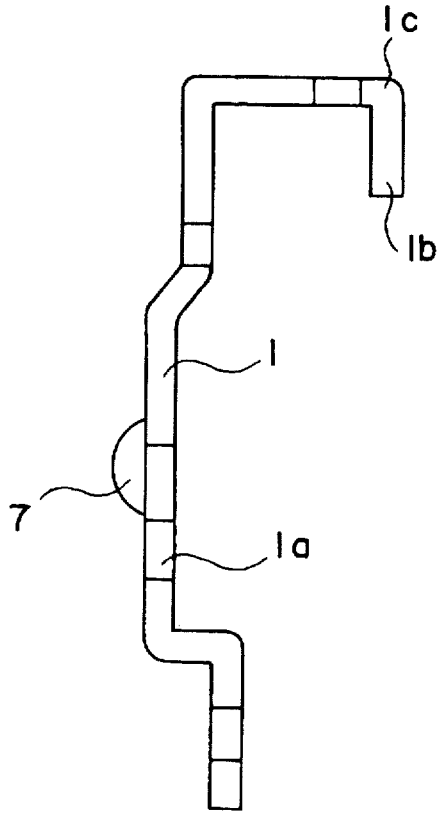
FIG. 6 is a side view of a trigger plate of the second embodiment.
Figure 7:
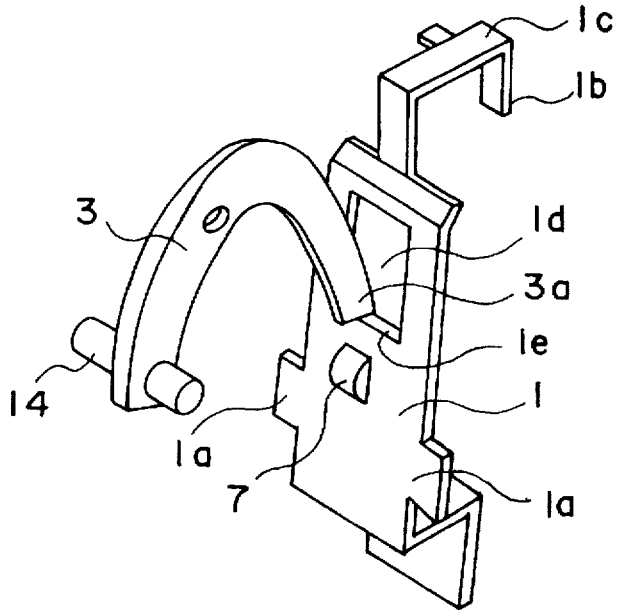
FIG. 7 is a perspective view showing an engagement state between the trigger plate shown in FIG. 6 and the cradle.
Figure 8:
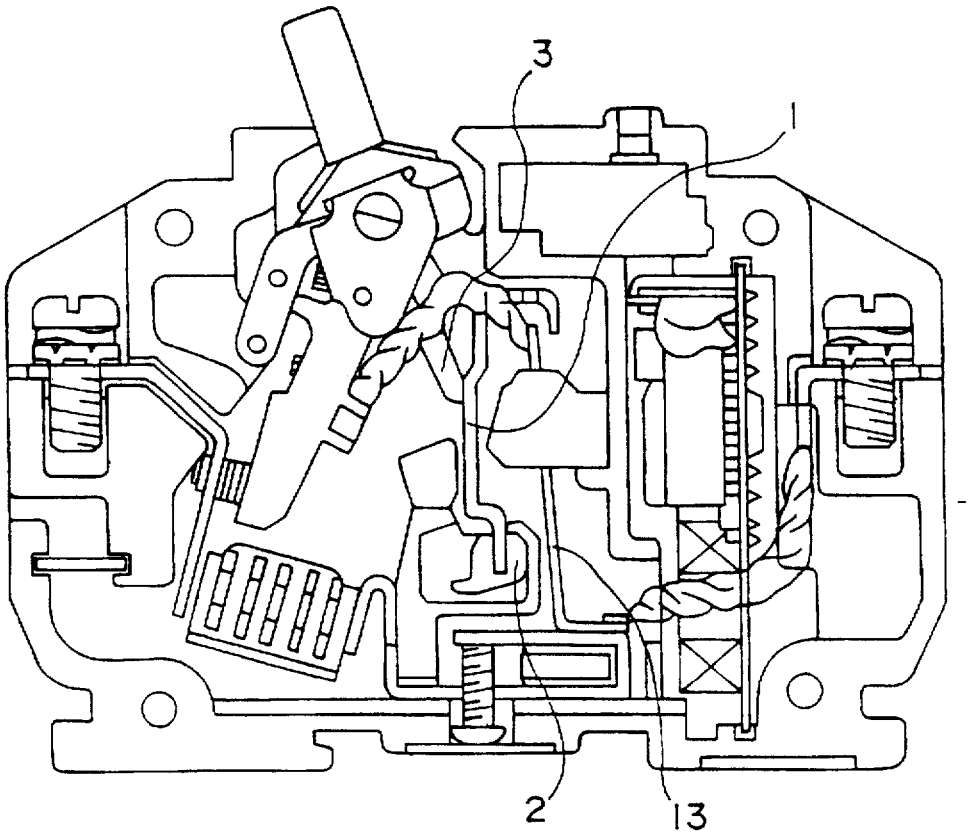
FIG. 8 (PRIOR ART)
FIG. 8 is a sectional view of a conventional multipolar circuit breaker under the ON-state.
Figure 9:
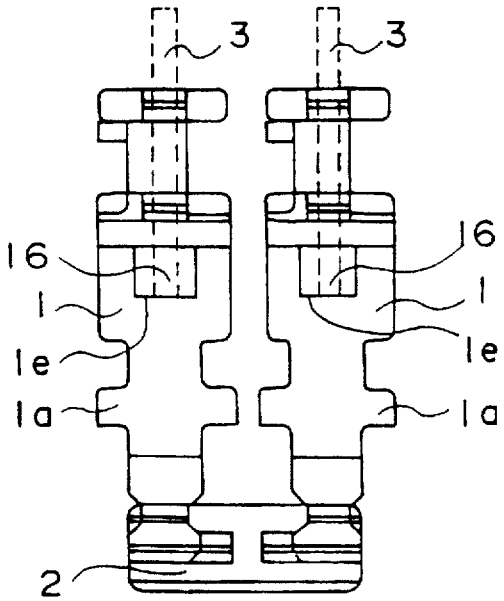
FIG. 9 (PRIOR ART)
FIG. 9 is a side view showing the portion of a trigger plate and trigger joint of a multipolar circuit breaker.

FIGS. 6 and 7 show the second embodiment of the present invention. In the case of the second embodiment, a protrusion 7 is formed on the trigger plate 1 slightly downward from the engagement position between the trigger plate 1 and the cradle 3 of each pole as shown in FIG. 6. The protrusion 7 does not contact the cradle 3 in the ON-state. However, when the trigger plate 1 of any pole operates, the front end 3*a* of the cradle 3 disengages and comes to the TRIP-state, the front end 3*a* of the cradle 3 pushes (or strikes) the protrusion 7 and further deeply moves the trigger plate 1 of the pole in the tripping direction.

As a result, the pushed (or struck) trigger plate 1 is more greatly moved than a conventional distance and therefore the trigger plates 1 of other poles connected by the trigger joint 2 are simultaneously also greatly moved. Thus, secure tripping is performed in the poles of other circuits.

Advantages of the Invention

As described above, the present invention has the advantage that when the tripping section of any pole operates, tripping sections of other poles can securely be operated even if there is a slight backlash between a trigger plate and a trigger joint.

What is claimed is:

1. A multipolar circuit breaker comprising:

a plurality of poles, each including a cradle which is removably engagable with a hole formed in a corresponding trigger plate; and a trigger joint connecting together the trigger plate of each of the poles, wherein the trigger plate of each of the poles has an upper portion which is swingable and a lower portion which operates as a fulcrum, and wherein the cradle of each of the poles includes a protrusion having a laterally displaced front end which pushes a side portion adjacent to the hole formed in the corresponding trigger plate so as to further move the corresponding trigger plate in a tripping direction when the cradle is tripped from the corresponding trigger plate, thereby ensuring that the trigger plate of each of the plurality of poles will be securely tripped through the trigger joint when the trigger plate of any one of the plurality of poles is tripped.

2. A multipolar circuit breaker comprising:

a plurality of poles, each including a trigger plate and a corresponding cradle; and a trigger joint connecting together the trigger plate of each of the poles, wherein the trigger plate of each of the poles has an upper portion which is swingable and a lower portion which operates as a fulcrum, and wherein the trigger plate of each of the poles includes a protrusion against which the corresponding cradle is pushed so as to further move the trigger plate in a tripping direction when the corresponding cradle is tripped from the trigger plate, thereby ensuring that the trigger plate of each of the plurality of poles will be securely tripped through the trigger joint when the trigger plate of any one of the plurality of poles is tripped.

* * * * *